United States Patent [19]

Mabuchi et al.

[11] 4,272,041

[45] Jun. 9, 1981

[54] MODEL HELICOPTER DEVICE

[75] Inventors: Kenichi Mabuchi; Tatsuo Katsunuma, both of Matsudo, Japan

[73] Assignee: Mabuchi Motor Co., Ltd., Tokyo, Japan

[21] Appl. No.: 938,965

[22] Filed: Sep. 1, 1978

[30] Foreign Application Priority Data

Sep. 6, 1977 [JP] Japan ..... 52/106952

[51] Int. Cl.[3] ..... B64C 27/82

[52] U.S. Cl. ..... 244/17.21; 46/75; 416/43

[58] Field of Search ..... 244/17.11, 17.13, 17.19, 244/17.21, 76 A, 76 R; 46/75, 248, 249; 416/43

[56] References Cited

U.S. PATENT DOCUMENTS 2,350,126 5/1944 Pitcairn ..... 244/17.21

FOREIGN PATENT DOCUMENTS 590863 7/1947 United Kingdom ..... 416/43

*Primary Examiner*—Galen L. Barefoot

[57] ABSTRACT

A model helicopter device wherein a countertorque generated in the helicopter body by changes in the revolution of a main rotor is canceled by substantially detecting the acceleration of the revolution of the main rotor and automatically adjusting the pitch of tail rotor blades in accordance with the detected acceleration.

6 Claims, 7 Drawing Figures

MODEL HELICOPTER DEVICE

BACKGROUND OF THE INVENTION

1. Field of the Invention

This invention relates generally to a model helicopter device, and more specifically to a model helicopter device having such a construction that the acceleration of the revolution of a main rotor is detected and the pitch of tail rotor blades is adjusted in accordance with the detected acceleration to cancel a countertorque generated in the helicopter body by changes in the revolution of the main rotor.

2. Description of the Prior Art

In the conventional type of model helicopter, a tail rotor is rotated in proportion to the revolution of the main rotor. However, when the revolution of the main rotor is suddenly changed, a countertorque is temporarily produced in the helicopter body. Among means for preventing such a countorque included are;

(1) An operator remotely controls the pitch of tail rotor blades together with the control of the rotating speed of the main rotor by means of a radio control device.

(2) A gyro is incorporated in the model helicopter to control the tail rotor by detecting a relative displacement angle between the gyro axis and the axis of the helicopter body.

(3) The tail rotor is controlled by electrically detecting the differential of the revolution of the main rotor.

All these conventional means are not desirable since Method (1) requires a skill in operating the radio control device and involves difficulty in operation, Method (2) becomes effective only when a relative displacement is caused and involves difficulty in minute control due to poor detecting sensitivity, and Method (3) requires a complicated and expensive control circuit.

This invention is intended to obviate the aforementioned problems by cancelling a countertorque generated in the helicopter body by a change in the revolution of the main rotor by detecting the magnitude of acceleration of the revolution of the main rotor when the revolution of the main rotor is changed, and automatically adjusting the pitch of the tail rotor blades in accordance with the detected magnitude of acceleration.

SUMMARY OF THE INVENTION

It is an object of this invention to provide a model helicopter device having such a construction that a countertorque generated in the helicopter body by the revolution of the main rotor is prevented.

It is another object of this invention to provide a rotating angle transmitting mechanism incorporated in the aforementioned device.

It is still another object of this invention to provide a transmission mechanism for transmitting drive force from the prime mover.

It is further object of this invention to provide a drive force transmitting mechanism and a tail rotor blade pitch adjusting mechanism in the tail rotor assembly.

FIGS. 1(*a*)–1(*d*) is a graphical representations illustrating the relation between the revolution of the main rotor and the countertorque, FIG. 2 is a perspective view illustrating an embodiment of this invention, FIG. 3 is a side view illustrating the intermeshing gear train shown in FIG. 2, FIG. 4 is a plan view of the portion of the gear assembly shown by the line X—X' in FIG. 3.

DETAILED DESCRIPTION OF THE EMBODIMENT

FIG. 1(*a*) is a graph illustrating changes in the revolution of the main rotor, FIG. 1(*b*) a graph showing a countertorque produced in accordance with the revolution of the main rotor, FIG. 1(*c*) a graph of a countertorque generated with changes in the revolution of the main rotor, and FIG. 1(*d*) a graph of a total countertorque combining countertorques shown in FIG. 1(*b*) and (*c*), respectively. As is apparent from the FIGS. 1(*a*)–(*d*) countertorque produced in the helicopter body by the revolution of a main rotor, as shown in FIG. 1(*d*), is a resultant force of a countertorque generated in accordance with the revolution of the main rotor as shown in FIG. 1(*b*) and a countertorque generated with changes in the revolution of the main rotor as shown in FIG. 1(*c*).

Consequently, a tail rotor, which revolves in proportion to the revolution of the main rotor, is provided in the tail portion of the helicopter to cancel the countertorque produced in accordance with the revolution of the main rotor, as shown in FIG. 1(*b*). However, when the pitch of the tail rotor blades is fixed, the countertorque in the helicopter body and the torque of the tail rotor can be balanced only at a certain revolution but cannot be matched over the entire revolution range. To cope with this, the difference between the countertorque and the torque of the tail rotor is compensated and the countertorque shown in FIG. 1(*b*) is canceled by increasing or decreasing the revolution of the tail rotor in accordance with the revolution of the main rotor, as will be described later. In practice, the pitch of the tail rotor blades is also changed. Furthermore, the countertorque due to the transient revolving acceleration at the time of changes in the revolution of the main rotor, as shown in FIG. 1(*c*) is canceled by detecting the acceleration of the main rotor and adjusting the pitch of the tail rotor blades, as will be described later.

As described above, the total countertorque shown in FIG. 1(*d*) can be canceled by adjusting the revolution and the pitch of the tail rotor, and thus the countertorque produced in the helicopter body by the revolution of the main rotor can be compensated.

In the following, an embodiment of this invention will be described referring to FIGS. 2 through 4.

Figure 1A:
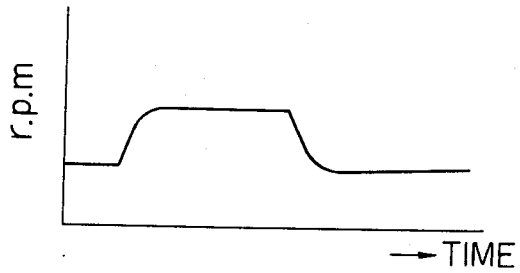
Figure 1B:
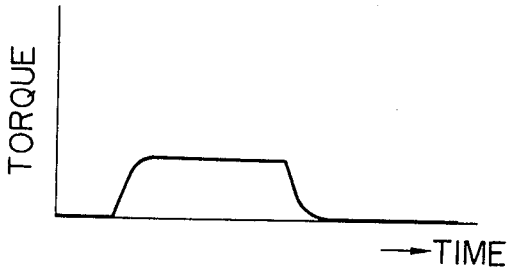
Figure 1C:
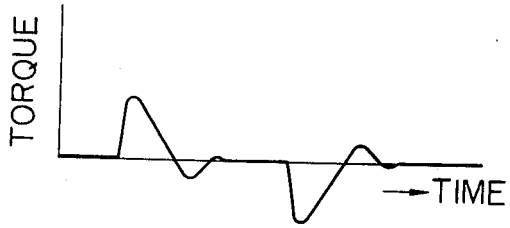
Figure 1D:
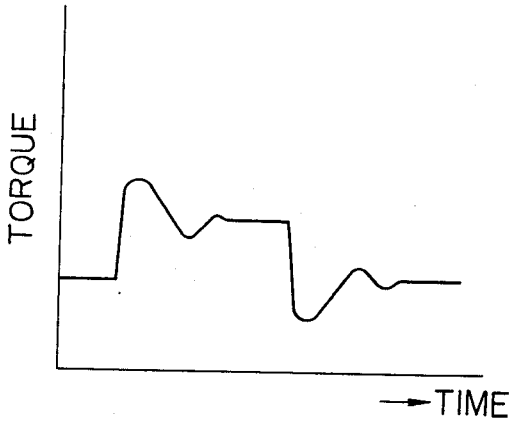
Figure 2:
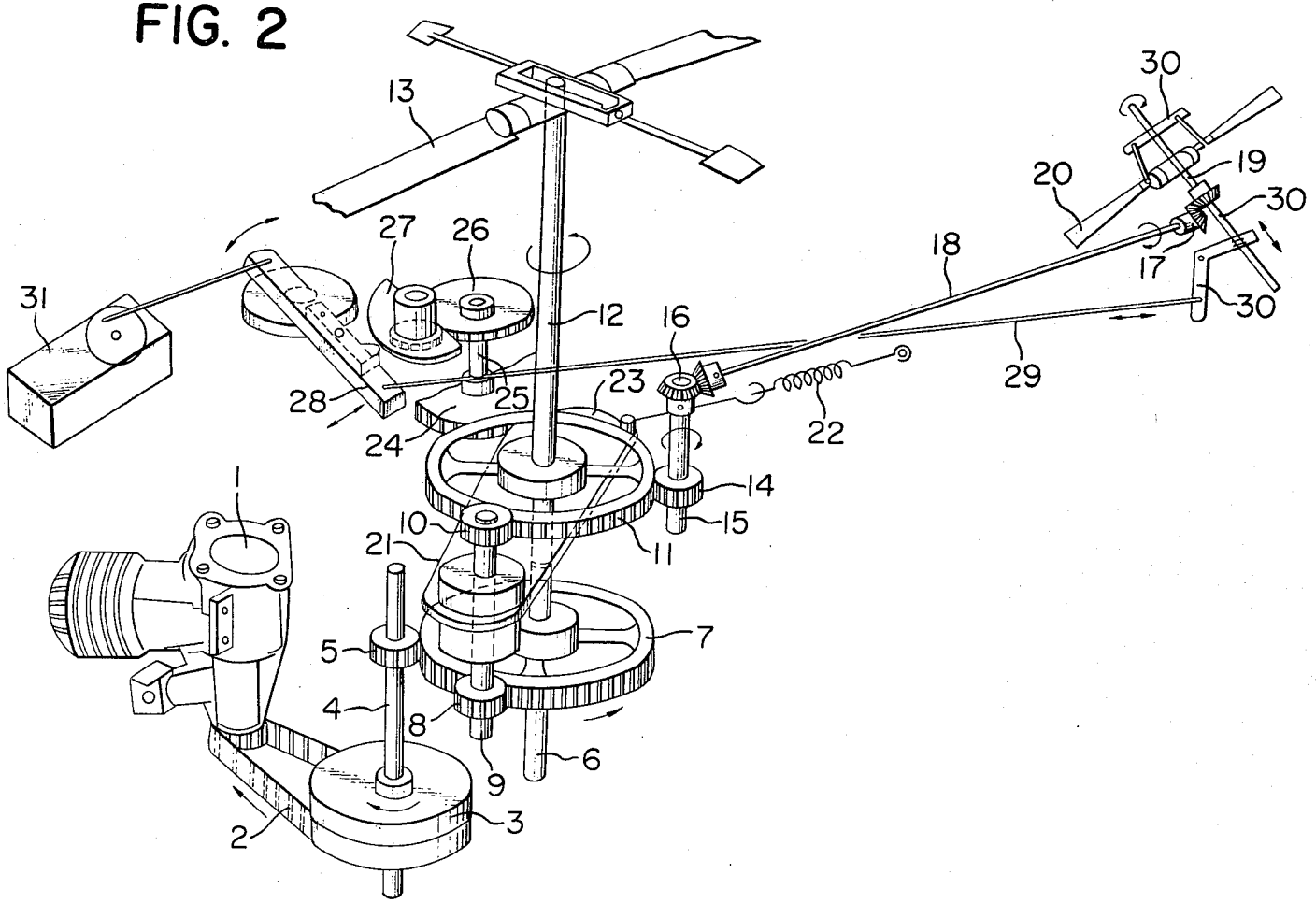
Figure 3:
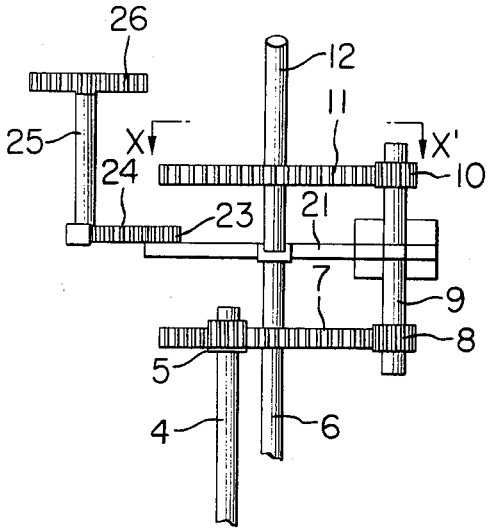
Figure 4:
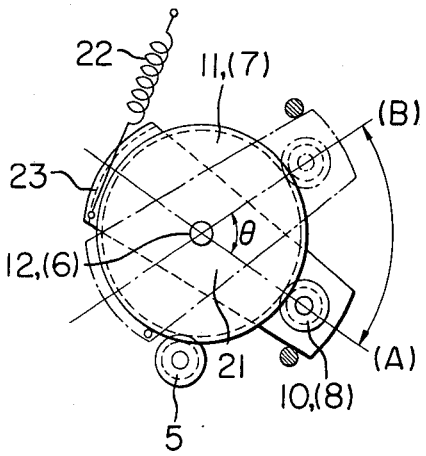

In FIGS. 2–4, numeral 1 refers to a prime mover (or an engine); 2 to a timing belt; 3 to a centrifugal clutch; 4 to a drive shaft; 5 to a third pinion; 6 to a second main shaft; 7 to a second main gear; 8 to a second pinion; 9 to a pinion shaft; 10 to a first pinion; 11 to a first main gear; 12 to a first main shaft; 13 to a main rotor; 14 to a fourth pinion; 15 to a bevel shaft; 16 to a first bevel gear; 17 to a second bevel gear; 18 to a connecting shaft; 19 to a tail rotor shaft; 20 to a tail rotor; 21 to a rotary plate; 22 to a spring; 23 to a rotating gear shaft; 26 to a second intermediate gear; 27 to a cam; 28 to an interlocking level; 29 to an interlocking shaft; 30 to a linkage; 31 to a servomotor, respectively.

In FIG. 2, the turning effort of the engine 1 is transmitted to the first main gear 11 via the timing belt 2, the centrifugal clutch 3, the drive shaft 4 to which the centrifugal clutch 3 is fixed, the third pinion 5 fixed to the drive shaft 4, the second main gear 7 fixed to the second main shaft 6, the second pinion 8, the pinion shaft 9 to which the second pinion 8 is fixed, and the first pinion 10 fixed to the pinion shaft 9. The turning effort thus transmitted to the first main gear is then transmitted to the first main shaft 12 to which the first main gear is fixed, giving a torque to the main rotor 13 fixed to the first main shaft 12 to cause the main rotor 13 to revolve at the number of revolution determined by the gear ratio of the abovementioned gears, thus causing the model helicopter to fly.

On the other hand, the revolving energy of the engine 1 is transmitted from the first main gear 11 to the fourth pinion 14 in mesh with the first main gear 11, causing the bevel shaft 15 to which the fourth pinion 14 is fixed to revolve, and then transmitted from the first bevel gear 16 fixed to the other end of the bevel shaft 15 to the second bevel gear 17 via the connecting shaft 18. The revolving energy of the engine 1 thus transmitted to the second bevel gear 17 is then transmitted to the tail rotor shaft 19 to which the second bevel gear 17 is fixed, giving a torque to the tail rotor 20 fixed to the tail rotor shaft 19 and causing the tail rotor 20 to revolve at the number of revolution in accordance with the abovementioned gear ratio.

As shown in FIGS. 2 and 3, the first pinion 10 and the second pinion 8 both fixed to the pinion shaft 9, are of the same shape and the same size, and the first mean gear 11 in mesh with the pinion 10 and the second main gear 7 in mesh with the pinion 8 are also of the same shape and the same size and are fixed to the first main shaft 12 and the second main shaft 6, respectively, both of the shaft 12 and the shaft 6 being on the same axis of rotation. The rotary plate 21 supporting the pinion shaft 9 is rotatably supported by the first main shaft 12. Consequently, the revolving energy of the engine 1 is transmitted to the first pinion 10 via the timing belt 2, the centrifugal clutch 3, the third pinion 5, the second main gear 7 and the second pinion 8. Thus, the first pinion 10 drives the first main gear 11 to cause the main rotor 13 via the first main shaft 12 to which the first main gear 11. When the second main gear 7 transmits the revolving energy to the second pinion 8, the second pinion 8 gives a reaction force to the second main gear 7. By the action of the reaction force, the rotary plate 21 rotatably supported by the first main shaft 12 is rotated in the direction of arrows shown in FIG. 4. The rotating angle $\theta$ of the rotary plate 21 corresponds with the magnitude of the reaction force. That is, the rotary plate 21 is supported by the spring 22, and the elasticity coefficient of the spring 22 is selected so that the rotary plate 21 is brought to position A in FIG. 4 when the main rotor is stopped and to position B when the reaction force is at its maximum. For this reason, the rotating angle $\theta$ caused by the reaction force increases as soon as the number of revolution of the main rotor 13 begins changing, and as the revolving acceleration of the main rotor 13 gradually decreases, approaching to the steady state, the rotating angle $\theta$ decreases to a vibratory overshot state. When the revolution of the main rotor 13 reaches a given number of revolution N, that is, loses its acceleration, the rotary plate 21 is brought to an angular position corresponding to the number of revolution N. In other words, the reaction force is converted into a rotating angle $\theta$ of the rotary plate 21, corresponding to the magnitude of the reaction force, and is transmitted the first intermediate gear 24 via the rotary gear 23 which is in a position opposite to the rotary plate 21. The rotation corresponding to the reaction force is sequentially transmitted to the intermediate shaft 25 and the second intermediate gear 26, both of which are integrally formed and rotated with the first intermediate gear 24, the cam 27, the interlocking lever 28, the interlocking shaft 29, and eventually transmitted to the linkage 30 connected to the interlocking shaft 29 for adjusting the pitch of the blades of the tail rotor 20. Thus, the pitch of the blades of the tail rotor 20 is automatically adjusted corresponding to the rotation of the rotary plate 21.

As is apparent from the foregoing description, the countertorque shown in FIG. 1(*b*), that is, the countertorque produced in the steady state revolution of the main rotor 13 can be canceled by adjusting the pitch of the blades of the tail rotor 20 corresponding to the rotating angle of the rotary plate 21 which rotates in accordance with the number of revolution N of the main rotor 13 and causing the tail rotor 20 to revolve at a revolution proportional to the number of revolution N of the main rotor 13. On the other hand, the countertorque shown in FIG. 1(*c*), that is, the countertorque produced by the revolving acceleration of the main rotor 13 resulting from changes in the number of revolution required for causing the model helicopter to ascend or descend can be canceled by adjusting the pitch of the blades of the tail rotor 20 in accordance with the rotating angle of the rotary plate 21 which rotates in accordance with the magnitude of the revolving acceleration of the main rotor 13. As shown in FIG. 2, the pitch of the blades of the tail rotor 20 is, in practical operation, fine adjusted by actuating the linkage 30 via the interlocking lever 28 and the interlocking shaft 29 by means of the servomotor 31 which is incorporated in the model helicopter and remote-controllable by a radio control device.

As is evident from the foregoing description, this invention makes it possible to cancel both the countertorque produced in the steady-state revolution of the main rotor of a helicopter and the countertorque generated with changes in the number of revolution of the main rotor by automatically controlling the number of revolution and the pitch of the tail rotor by the use of mechanical means and to prevent the rotation of the helicopter body due to the revolution of the main rotor to ensure stabilized flight of the model helicopter. Since the required construction for attaining these object is only a relative rotation of driving gears and driven gears, the model helicopter device of this invention has an advantage in simple construction and high detecting sensitivity.

What is claimed is:

1. A device for a toy helicopter having a tail rotor in the tail portion to prevent the rotation of the helicopter body due to the countertorque of the revolution of a main rotor, said device comprising a tail rotor blade pitch adjusting mechanism for adjusting the pitch of the tail rotor blades, a servomotor for controlling the tail rotor blade pitch adjusting mechanism by receiving remote control signals from the radio control device, a linkage for driving the tail rotor blade pitch adjusting mechanism, a first main gear fixed to a first main shaft to which the main rotor is fixed, a first pinion for transmitting revolving energy to the first main gear, a pinion shaft to which the first pinion is fixed and which is rotatably supported along the first main gear while the first pinion is in mesh with the first main gear, and a rotating angle transmitting mechanism which detects and transmits the rotating angle of the pinion shaft to the linkage, and wherein the rotating angle of the pinion shaft which rotates in accordance with changes in the number of revolutions of the main rotor is transmitted to the tail rotor blade pitch adjusting mechanism via the rotating angle transmitting mechanism and the linkage to automatically adjust the pitch of the tail rotor blades, the rotating angle transmitting mechanism comprising a rotary plate which supports the pinion shaft, said rotary blade being supported by the first main shaft and rotating, together with the pinion shaft around the axis of the first main shaft, an intermediate gear which is fixed to the rotary plate and which transmits the rotating angle of the pinion shaft, and a cam which is in mesh with the intermediate gear and which transmits the rotating angle of the pinion shaft to the linkage, and wherein the rotating angle of the pinion shaft is automatically transmitted to the linkage and wherein the linkage is constructed so as to be controlled by a servomotor which is remotely-controllable by a radio control device.

2. A device for a toy helicopter having a tail rotor in the tail portion to prevent the rotation of the helicopter body due to the countertorque of the revolution of a main rotor, said device comprising a tail rotor blade pitch adjusting mechanism for adjusting the pitch of the tail rotor blades, a servomotor for controlling the tail rotor blade pitch adjusting mechanism by receiving remote control signals from a radio control device, a linkage for driving the tail rotor blade pitch adjusting mechanism, a first main gear fixed to a first main shaft to which the main rotor is fixed, a first pinion for transmitting revolving energy to the first main gear, a pinion shaft to which the first pinion is fixed and which is rotatably supported along the first main gear while the first pinion is in mesh with the first main gear, and a rotating angle transmitting mechanism which detects and transmits the rotating angle of the pinion shaft to the linkage, and wherein the rotating angle of the pinion shaft which rotates in accordance with changes in the number of revolutions of the main rotor is transmitted to the tail rotor blade pitch adjusting mechanism via the rotating angle transmitting mechanism and the linkage to automatically adjust the pitch of the tail rotor blades, the tail portion of the helicopter further including a second bevel gear to which the number of revolutions corresponding to the number of revolutions of the main rotor is transmitted, a second linkage for actuating the tail rotor blade pitch adjusting mechanism in accordance with changes in the number of revolutions of the main rotor, and wherein the revolving force in accordance with the number of revolutions of the first main gear is transmitted to the second bevel gear via the third pinion which is in mesh with the first main gear rotating together with the main rotor and which rotates in accordance with the number of revolutions of the main rotor, a bevel shaft to which the third pinion is fixed, a first bevel gear which is fixed to the other end of the bevel shaft, and a connecting shaft, the changes in the number of revolutions of the main rotor being detected in the form of a rotating angle of a rotary plate which is rotatably supported by the first main shaft, the detected rotated angle of the rotary plate being transmitted to the linkage via an intermediate gear that is fixed to the rotary plate and an interlocking shaft.

3. A device for a toy helicopter having a tail rotor in the tail portion to prevent the rotation of the helicopter body due to the countertorque of the revolution of a main rotor, said device comprising a tail rotor blade pitch adjusting mechanism for adjusting the pitch of the tail rotor blades, a servomotor for controlling the tail rotor blade pitch adjusting mechanism by receiving remote control signals from a radio control device, a linkage for driving the tail rotor blade pitch adjusting mechanism, a first main gear fixed to a first main shaft to which the main rotor is fixed, a first pinion for transmitting revolving energy to the first main gear, a pinion shaft to which the first pinion is fixed and which is rotatably supported along the first main gear while the first pinion is in mesh with the first main gear, and a rotating angle transmitting mechanism which detects and transmits the rotating angle of the pinion shaft to the linkage, wherein the rotating angle of the pinion shaft which rotates in accordance with changes in the number of revolutions of the main rotor is transmitted to the tail rotor blade pitch adjusting mechanism via the rotating angle transmitting mechanism and the linkage to automatically adjust the pitch of the tail rotor blades and wherein the rotating angle transmitting mechanism comprises a rotary plate which supports the pinion shaft, is rotatably supported by the first main shaft and rotates, together with the pinion shaft, around the axis of the first main shaft, an intermediate gear which is fixed to the rotary plate and transmits the rotating angle of the pinion shaft, and a cam which is in mesh with the intermediate gear and transmits the rotating angle of the pinion shaft to the linkage, and wherein the rotating angle of the pinion shaft is automatically transmitted to the linkage, and wherein the linkage is constructed so as to be controlled by a servomotor which is remote-controlled by a radio control device.

4. A device as set forth in claim 3 wherein the first pinion is fixed to the pinion shaft and is driven by a second pinion which is formed in the same shape and size as those of the first pinion, the second pinion being in mesh with a second main gear which is formed in the same shape and size as those of the first main gear and is fixed to a second main shaft which is on the same axis of rotation as that of the first main shaft, there being further included a prime mover having a revolving force that is transmitted to the first pinion via the second main gear and the second pinion.

5. A device for a toy helicopter having a tail rotor in the tail portion to prevent the rotation of the helicopter body due to the countertorque of the revolution of a main rotor, said device comprising a tail rotor blade pitch adjusting mechanism for adjusting the pitch of the tail rotor blades, a servomotor for controlling the tail rotor blade pitch adjusting mechanism by receiving remote control signals from a radio control device, a linkage for driving the tail rotor blade pitch adjusting mechanism, a first main gear fixed to a first main shaft to which the main rotor is fixed, a first pinion for transmitting revolving energy to the first main gear, a pinion shaft to which the first pinion is fixed and which is rotatably supported along the first main gear while the first pinion is in mesh with the first main gear, and a rotating angle transmitting mechanism which detects and transmits the rotating angle of the pinion shaft to the linkage which rotates in accordance with changes in the number of revolutions of the main rotor is transmitted to the tail rotor blade pitch adjusting mechanism via the rotating angle transmitting mechanism and the linkage to automatically adjust the pitch of the tail rotor blades and wherein the tail portion of the helicopter has a second bevel gear to which the number of revolutions corresponding to the number of revolutions of the main rotor is transmitted, a linkage for actuating the tail rotor blade pitch adjusting mechanism in accordance with changes in the number of revolutions of the main rotor, and wherein the revolving force in accordance with the number of revolutions of the first main gear is transmitted to the second bevel gear via a third pinion which is in mesh with the first main gear rotating together with the main rotor and rotates in accordance with the number of revolutions of the main rotor, a bevel shaft to which the third pinion is fixed, a first bevel gear which is fixed to the other end of the bevel shaft and rotates together with the bevel shaft, and a connecting shaft, and that the changes in the number of revolutions of the main rotor is detected in the form of a rotating angle of a rotary plate which is rotatably supported by the first main shaft, and that the detected rotating angle of the rotary plate is transmitted to the linkage via an intermediate gear fixed to the rotary plate and an interlocking shaft.

6. A device as set forth in claim 5 wherein the first pinion is fixed to the pinion shaft and is driven by a second pinion which is formed in the same shape and size as those of the first pinion, the second pinion being in mesh with a second main gear which is formed in the same shape and size as those of the first main gear and is fixed to a second main shaft which is on the same axis of rotation as that of the first main shaft, there being further included a prime mover having a revolving force that is transmitted to the first pinion via the second main gear and the second pinion.

* * * * *